US008821154B2

(12) United States Patent
Yamashita et al.

(10) Patent No.: US 8,821,154 B2
(45) Date of Patent: Sep. 2, 2014

(54) COMBUSTION APPARATUS AND METHOD FOR COMBUSTION CONTROL THEREOF

(75) Inventors: Akihito Yamashita, Fuji (JP); Kazushi Iwama, Fuji (JP); Yuichi Mochizuki, Fuji (JP); Katsumi Naitoh, Fuji (JP)

(73) Assignee: Purpose Company Limited, Fuji-shi (JP)

( * ) Notice: Subject to any disclaimer, the term of this patent is extended or adjusted under 35 U.S.C. 154(b) by 847 days.

(21) Appl. No.: 12/942,198

(22) Filed: Nov. 9, 2010

(65) Prior Publication Data

US 2012/0115093 A1 May 10, 2012

(51) Int. Cl.

| | |
|---|---|
| ***F23N 5/00*** | (2006.01) |
| ***F23N 1/02*** | (2006.01) |
| ***F23D 14/72*** | (2006.01) |
| ***F23N 5/24*** | (2006.01) |
| ***F23N 5/12*** | (2006.01) |

(52) U.S. Cl.

CPC ..... *F23N 1/022* (2013.01); *F23D 14/725* (2013.01); *F23N 5/242* (2013.01); *F23N 2029/16* (2013.01); *F23N 2031/26* (2013.01); *F23N 5/123* (2013.01); *F23N 2031/06* (2013.01)

USPC ..... 431/75; 431/12; 431/25; 431/66; 431/72

(58) Field of Classification Search

USPC ..... 431/12, 66, 72, 75, 25

See application file for complete search history.

(56) References Cited

U.S. PATENT DOCUMENTS

| | | | | | |
|---|---|---|---|---|---|
| 2,775,291 | A | * | 12/1956 | Wilson | 431/24 |
| 2,940,255 | A | * | 6/1960 | MacCracken | 60/39.281 |
| 3,301,307 | A | * | 1/1967 | Nishigaki et al. | 431/15 |
| 3,520,645 | A | * | 7/1970 | Cotton et al. | 431/78 |
| 4,107,657 | A | * | 8/1978 | Nishigaki et al. | 340/579 |
| 4,588,372 | A | * | 5/1986 | Torborg | 431/78 |
| 4,710,125 | A | * | 12/1987 | Nakamura et al. | 431/22 |
| 4,859,171 | A | * | 8/1989 | Altemark et al. | 431/12 |
| 5,049,063 | A | * | 9/1991 | Kishida et al. | 431/78 |
| 5,439,374 | A | * | 8/1995 | Jamieson | 431/25 |
| 5,472,337 | A | * | 12/1995 | Guerra | 431/78 |

(Continued)

FOREIGN PATENT DOCUMENTS

| | | | | | |
|---|---|---|---|---|---|
| JP | 04136611 | A | * | 5/1992 | F23N 3/08 |
| JP | 5-026438 | A | | 2/1993 | |

(Continued)

OTHER PUBLICATIONS

JPH04136611A—Espacenet English Abstract.*

*Primary Examiner* — Kenneth Rinehart
*Assistant Examiner* — Jorge Pereiro
(74) *Attorney, Agent, or Firm* — Westerman, Hattori, Daniels & Adrian, LLP

(57) ABSTRACT

A combustion apparatus. Combustion means (burner) generates flame by combustion. Air supply means (intake fan) supplies air to the combustion means. Flame current detecting means (FRB) is set at a certain detection position and detects a flame current value included in the flame which is generated by the combustion means. Determination means (control device) determines a distribution where the flame current value that is detected is included for the flame current detecting means. Control means (control device), when the flame current value is not included in a distribution, which is set as normal values, outputs a control command of increasing or decreasing at least one of the supply of the air by the air supply means and the supply of fuel based on a determination result by the determination means.

14 Claims, 12 Drawing Sheets

(56) References Cited

U.S. PATENT DOCUMENTS

| | | | | |
|---|---|---|---|---|
| 5,899,683 | A * | 5/1999 | Nolte et al. | 431/25 |
| 5,924,859 | A * | 7/1999 | Nolte et al. | 431/12 |
| 5,952,930 | A * | 9/1999 | Umeda et al. | 340/579 |
| 5,971,745 | A * | 10/1999 | Bassett et al. | 431/12 |
| 6,299,433 | B1 * | 10/2001 | Gauba et al. | 431/12 |
| 7,051,683 | B1 * | 5/2006 | Lee et al. | 122/14.21 |
| 7,927,095 | B1 * | 4/2011 | Chorpening et al. | 431/66 |
| 7,979,163 | B2 * | 7/2011 | Terlson et al. | 700/276 |
| 2001/0051321 | A1 * | 12/2001 | La Fontaine | 431/12 |
| 2011/0146651 | A1 * | 6/2011 | Puranen et al. | 126/116 A |
| 2011/0313637 | A1 * | 12/2011 | Yamashita et al. | 701/103 |
| 2012/0090560 | A1 * | 4/2012 | Iwama et al. | 122/14.3 |

FOREIGN PATENT DOCUMENTS

| | | | |
|---|---|---|---|
| JP | 6-011139 | A | 1/1994 |
| JP | 6-323532 | A | 11/1994 |
| JP | 7-004639 | A | 1/1995 |

* cited by examiner

FIG.10

104

| | | DIPSW 1 | |
|---|---|---|---|
| | | OFF | ON |
| DIPSW 2 | OFF | INITIAL STATE | HEIGHT 1 UP ROTATION SPEED BY X % |
| | ON | HEIGHT 2 UP ROTATION SPEED BY Y % | HEIGHT 3 UP ROTATION SPEED BY Z % |

COMBUSTION APPARATUS AND METHOD FOR COMBUSTION CONTROL THEREOF

BACKGROUND OF THE INVENTION

1. Field of the Invention

The present invention relates to a combustion apparatus in which a burner of combustion means is monitored and the supply of air thereto is adjusted and controlled, and a method for combustion control thereof.

2. Description of the Related Art

Conventionally, in a combustion apparatus, occurrence of going out of flame during halfway combustion and incomplete combustion for some reason is monitored, and control is performed that the supply of fuel or air is adjusted so as to perform combustion operation with proper air-fuel ratio. For monitoring condition of combustion, a thermocouple, a detector that detects the level of CO in exhaust and detection of flame current by a flame rod are used, for example.

As an apparatus for processes of monitoring and adjusting condition of combustion like the above, for example: a thermocouple is used, a thermal time constant of the thermocouple is stored when the apparatus is used, and correcting means predicts a steady-state value of the thermocouple by a time constant to output the value for an output change of the thermocouple according to the change of the condition of combustion; the predicted value is compared with a setting value of condition setting means, and air supply control means is controlled to increase or decrease the supply of air according to positive and negative deviations and the level thereof (for example, Japanese Laid-open Patent Publication No. 07-004639).

There is also an apparatus that: a detected value of the level of CO in exhaust by a CO sensor is compared with a reference value of the level of CO corrected according to the amount of combustion gas to judge incomplete combustion; if an integrated value obtained from deviation of the reference value and the detected value exceeds a safety limit, an alarm is issued, operation is stopped and reuse of the apparatus is allowed (for example, Japanese Laid-open Patent Publication No. 05-026438).

There is a combustion implement in which: occurrence of a deficiency of operating conditions such as a suction air blockage and an abnormal drop of an air supplying function of a blower, an exhaust blockage due to a damage of an exhaust cylinder to be connected to a port and adherence of unburned carbon to fins of an exchanger, and damage of a chamber due to heating is detected via a pressure of the chamber; abnormality is decided and the operation is inhibited etc. (for example, Japanese Laid-open Patent Publication No. 06-011139).

There is an art: each of a first burner and a second burner is provided with first and second flame rods; flame sensing currents is sensed individually, and then the rotation of a fan is controlled according to condition of combustion; air volume variable control is preferentially carried out as to the second burner (for example, Japanese Laid-open Patent Publication No. 06-323532).

In monitoring of combustion of a burner disposed in a combustion apparatus, there is a problem that when a thermocouple is used, for example, the thermocouple cannot react to a sudden change of air-fuel ratio because there occurs a delay in response until the thermocouple is heated, and cannot react to abnormal heating, blow-out of flame, a backfire, etc. There is also an apparatus of executing correction by expectancy in order to react to such response. However, there is a limit on increasing the response speed by expectancy while accurate monitoring control is maintained.

In combustion monitoring using a CO sensor and a pressure sensor, a circuit and a control unit for monitoring are needed individually. Thus, structure therefor must be complicated and the number of components must be increased.

Further, in a combustion apparatus providing a plurality of kinds of burners, components are increased and a control process is complicated for disposing monitoring means in each of the burners.

Concerning such problems, there is no disclosure or suggestion thereof in Japanese Laid-open Patent Publications Nos. 07-004639, 05-026438, 06-011139 and 06-323532, and no disclosure or suggestion about the structure etc. for solving them is presented.

SUMMARY OF THE INVENTION

An object of the present invention is to enhance the accuracy of monitoring for combustion of a burner, and to improve the swiftness of a response process in abnormal condition detection.

Another object of the present invention is to improve the safety of a combustion apparatus, and to improve the convenience thereof by preventing time when the combustion apparatus can be used from changing due to an environment where the combustion apparatus is disposed.

To achieve the above objects, a combustion apparatus of the present invention includes combustion means, air supply means, flame current detecting means, determination means and control means. The combustion means generates flame by combustion. The air supply means supplies air to the combustion means. The flame current detecting means is set at a certain detection position and detects a flame current value included in the flame which is generated by the combustion means. The determination means determines a distribution where the flame current value that is detected is included for the flame current detecting means. The control means, when the flame current value is not included in a distribution, which is set as normal values, outputs a control command of increasing or decreasing at least one of the supply of the air by the air supply means and the supply of fuel based on a determination result by the determination means.

The combustion apparatus of the present invention may further include flame detecting means that detects whether there is the flame or not in the combustion means, wherein the determination means executes, when the flame detecting means detects the flame, a determination process of the distribution of the flame current value from the flame current detecting means.

In the combustion apparatus of the present invention, the control means preferably may stop the combustion of the combustion means when the determination result is over a threshold level representing an exhaust blockage.

The combustion apparatus of the present invention may further include an environment information setting means that takes in environment information, wherein the control means changes ratio of increase and decrease of the supply of the air of the air supply means according to the environment information that is taken in or that is set.

To achieve the above objects, a method for combustion control of the present invention includes combusting, supplying air, detecting a flame current value, determining and controlling. Said combusting generates flame by combustion of combustion means. Said supplying air supplies air to the combustion means by air supply means. Said detecting a flame current value detects a flame current value included in the flame, which is generated, by the flame current detecting means set at a certain detection position. Said determining determines a distribution where the flame current value that is detected is included for the flame current detecting means. Said controlling, when the flame current value is not included in a distribution, which is set as normal values, increases or decreases at least one of the supply of the air by the air supply means and the supply of fuel based on a determination result by said determining.

The method for combustion control of the present invention may further include detecting whether there is the flame, which is generated by the combustion means, or not, and executing, when the flame is detected, the determination process of the distribution of the flame current value from the flame current detecting means.

The method for combustion control of the present invention may further include stopping the combustion when the determination result is over a threshold level representing an exhaust blockage.

The method for combustion control of the present invention may further include taking in environment information, and changing ratio of increase and decrease of the supply of the air of the air supply means according to the environment information that is taken in or that is set.

According to the combustion apparatus of the present invention or the method for combustion control thereof as described above, any of the following effects can be obtained.

(1) A change of condition of combustion of combustion means is rapidly detected by a change of a detected current value of flame current detecting means disposed in a predetermined monitoring position, and control such as improvement and stop of the combustion is performed. Thereby, the safety can be improved.

(2) Sudden deterioration of a combustion environment due to an exhaust blockage etc. can be detected by detection of a flame current value. Thereby, the safety can be improved.

(3) Combustion control can be performed according to an environment where a combustion apparatus is disposed by changing the ratio of the controlled supply of air and fuel according to the environment. Thereby, the convenience of the combustion apparatus can be improved.

Other objects, features and advantages of the present invention are more clearly understood by referring to the attached drawings and each of embodiments.

BRIEF DESCRIPTION OF THE DRAWINGS

FIG. 10 depicts an example of structure of a setting table of dipswitches;

DETAILED DESCRIPTION OF THE PREFERRED EMBODIMENTS

First Embodiment

Figure 1:
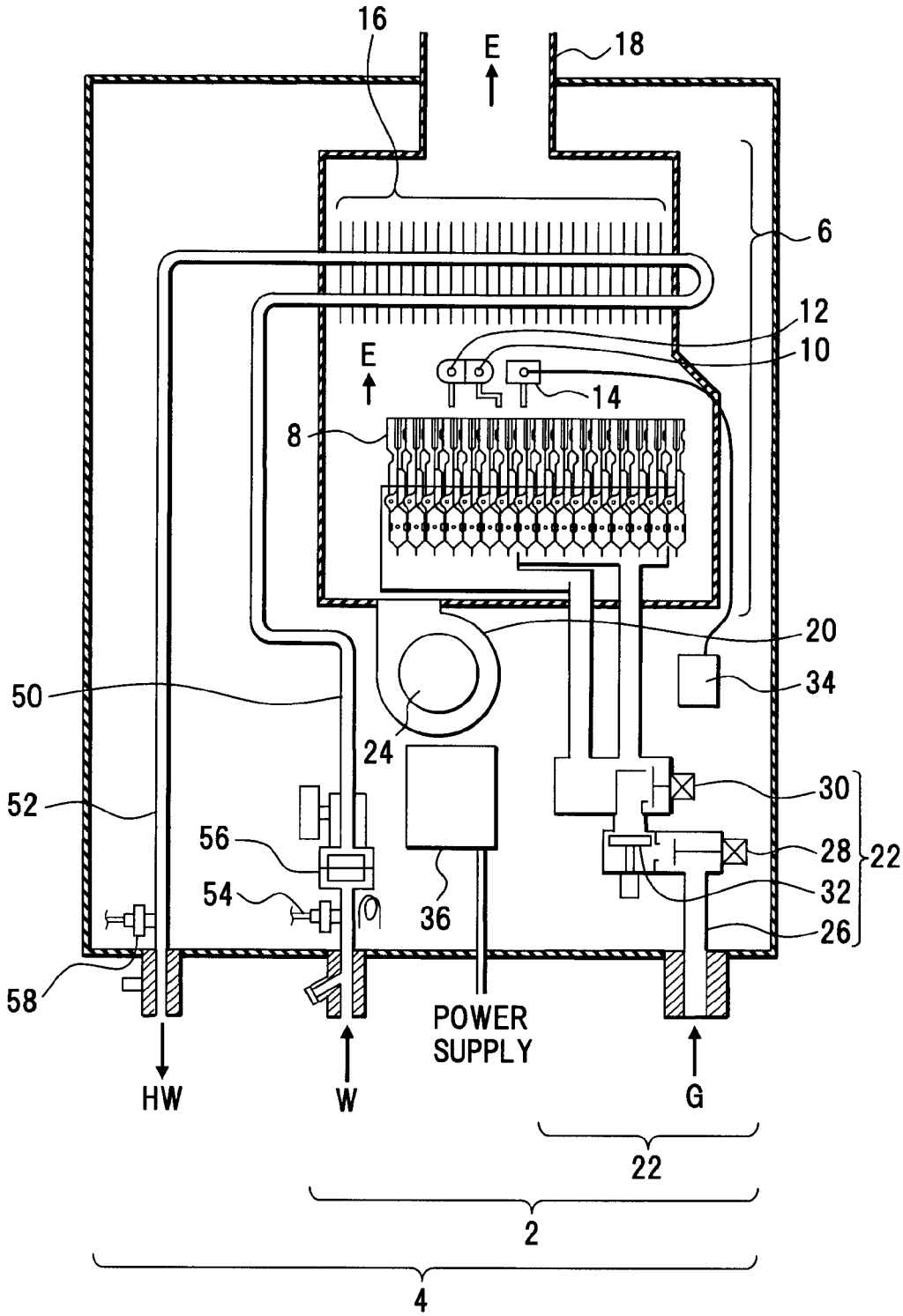
FIG. 1 depicts an example of structure of a water heater according to a first embodiment.
Figure 2:
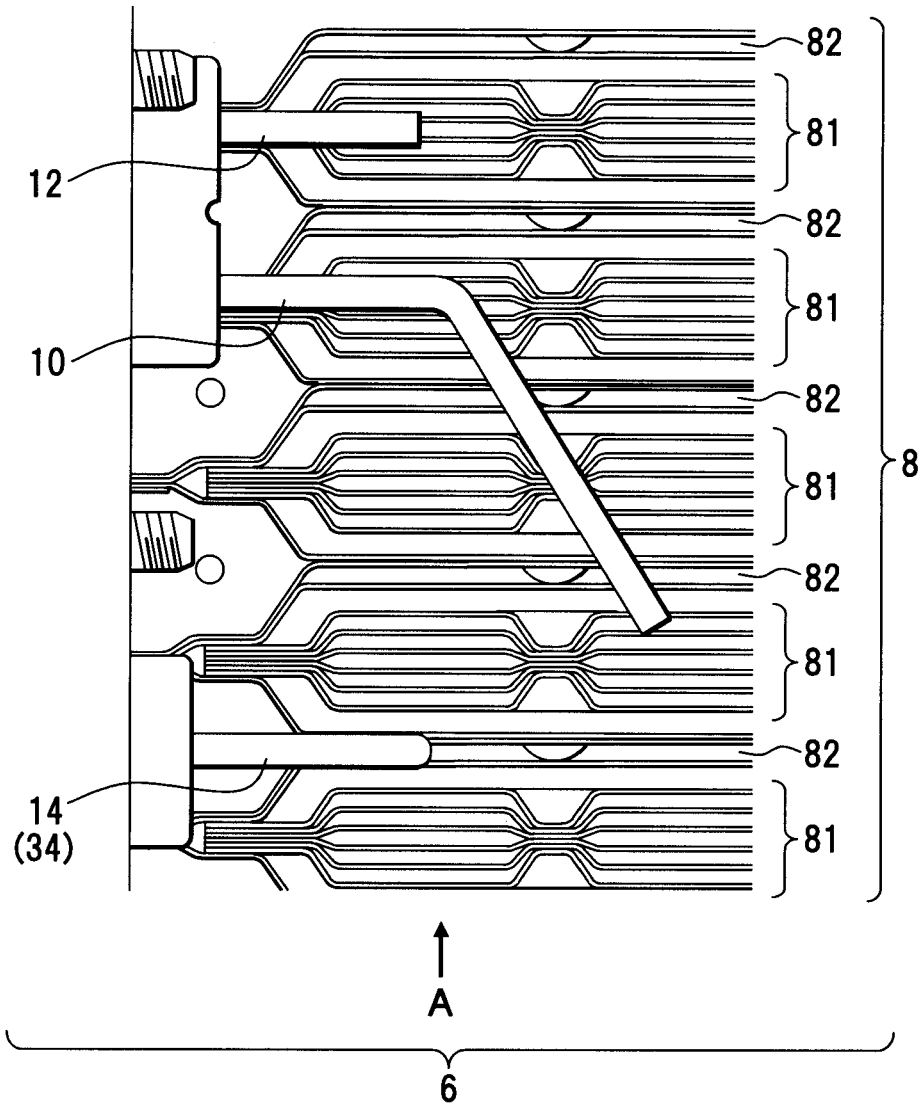
FIG. 2 depicts an example of structure of a burner and flame rods.
Figure 3:
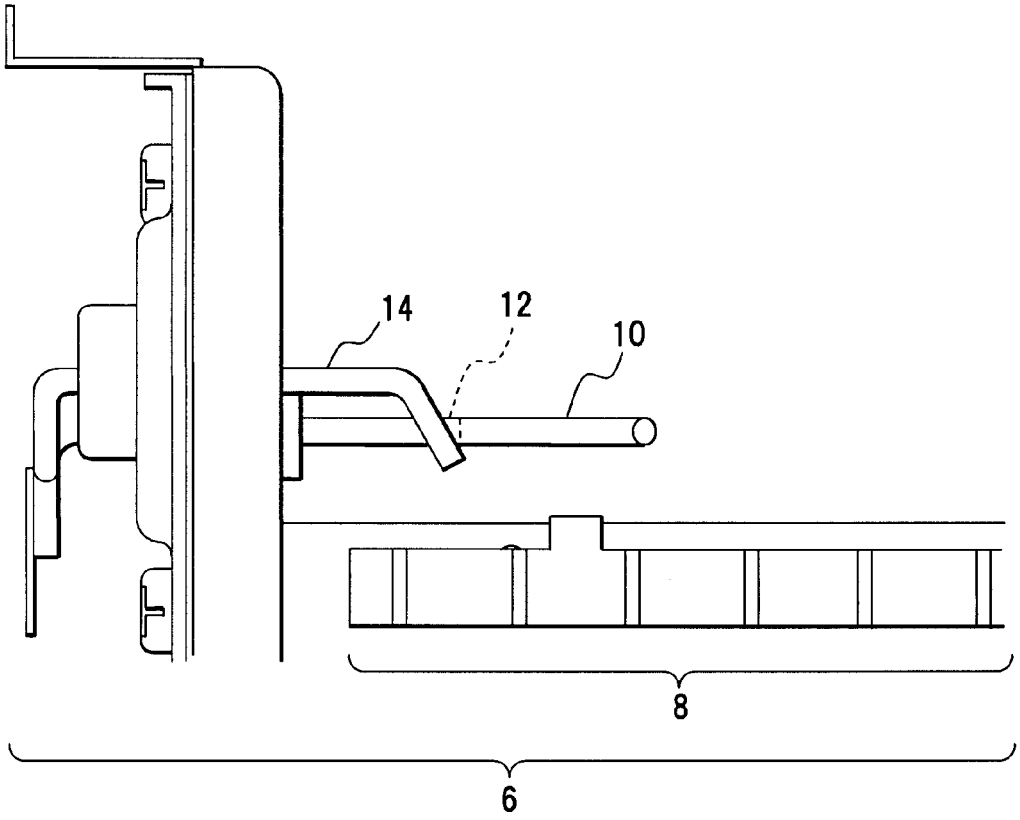
FIG. 3 is a side view depicting the example of structure viewed from an arrow A of FIG. 2.
Figure 4:
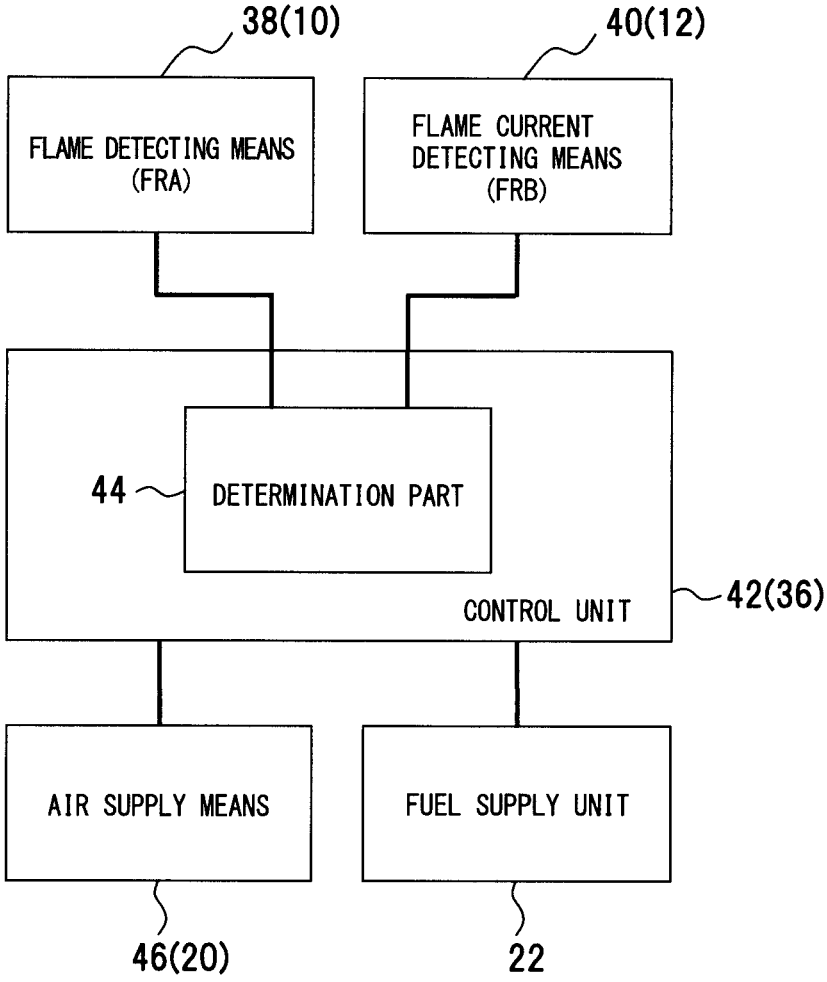
FIG. 4 depicts an example of function blocks of the combustion apparatus.

A first embodiment will be described with reference to FIGS. 1 to 4. FIG. 1 depicts an example of structure of a water heater according to the first embodiment, FIG. 2 depicts an example of structure of a burner and flame rods, FIG. 3 is a side view depicting the example of structure viewed from an arrow A of FIG. 2 and FIG. 4 depicts an example of function blocks of a combustion apparatus. Each structure of FIGS. 1 to 4 is an example and does not limit the present invention.

This combustion apparatus 2 is an example of a combustion apparatus of the present invention, and is a heat pump of a water heater 4 or the like in which supplied water W or the like is heated by heat exchange with exhaust E generated by combustion of fuel gas G or the like and hot water HW is supplied out thereof. The combustion device 2 depicted in FIG. 1 includes, for example, a burner 8, flame rods 10 and 12 and a spark plug 14 in a combustion chamber 6 thereof, and includes a heat exchanger 16 that exchanges heat of the supplied water W for the exhaust E. A vent 18 is disposed at the ceiling, and an intake fan 20 is connected to the bottom of the combustion chamber 6 to discharge the exhaust E to the outside of the combustion apparatus. A fuel supply unit 22 etc. are connected to the burner 8 at the outside of the combustion chamber 6.

The burner 8 is an example of combustion means, and, for example, combusts the fuel gas G supplied from a gas supply pipe 26 to generate the exhaust E. As to this combustion by the burner 8, combustion control is performed based on, for example, the flow rate of the supplied water W, heat of which is to be exchanged, and water heating setting temperature for the water heater 4. The burner 8 may be controlled by a block or each plurality of blocks separately. In combustion control based on water heating setting temperature, the burner 8 may be switched by each block based on required quantity of heat. Or, the strength of flame may be changed by controlling the supply of the fuel gas G.

The intake fan 20 is an example of combustion air supply means for the burner 8, and, for example, rotates a fan motor 24. Thereby, air for combustion can be sent to the burner 8.

The fuel supply unit 22 is an example of supply means of the fuel gas G for the burner 8. The fuel gas G is supplied to the burner 8 by opening a main gas valve 28 in the gas supply pipe 26 and opening a gas solenoid valve 30. The supply of the fuel gas G etc. are determined according to the opening of the gas proportional valve 32.

The flame rod 10 (hereinafter, "FRA") is an example of flame detecting means for detecting whether there is flame on the burner 8 or not. As to the FRA 10, a rod made of heat resistant steel is disposed in the vicinity of the burner 8, and it is detected whether there is flame (ON) or not (OFF) using electroconductivity of flame. For example, if current equal to or over a threshold level can be detected, it is determined that flame is in combustion condition.

The flame rod 12 (hereinafter "FRB") is an example of flame current detecting means and, for example, provides an air-fuel ratio rod that measures the mixture ratio of air to fuel during combustion, the exhaust blockage ratio and the level of CO in the combustion apparatus 2. The FRB 12 sets a certain detection position, detects a flame current value of the burner 8, analyzes air-fuel ratio etc. based on the detected current value, and determines condition of flame (combustion condition).

The spark plug 14 is an example of ignition means for the burner 8 and connected to an igniter 34 that executes ignition control. The igniter 34 is an example of an ignition device under electric control and is means for making the spark plug 14 discharge at a predetermined timing according to a combustion control process.

The FRA 10 and the FRB 12 depicted in FIG. 2 or 3 are an example of arrangement for the burner 8. In this case, for example, the FRB 12 is made shorter than the FRA 10, is directed to a lean burner 81 in the burner 8 to be arranged, and detects flame current as an air-fuel ratio rod. Also, for example, the FRA 10 that is bent in parallel to a flame hole of the burner 8 is arranged across the lean burner 81 and a rich burner 82 in the burner 8, and detects whether there is flame or not.

Since a larger flame current value can be obtained from the rich burner 82 than the lean burner 81, the rich burner 82 has an advantage when it is detected whether there is flame or not. Thus, the FRA 10 is directed to the rich burner 82 to be arranged. Also, a change of a current value of the rich burner 82 according to a change of the amount of included air is small. Therefore, the rich burner 82 has a characteristic of being difficult to be used for monitoring air-fuel ratio. Thus, flame current is detected at the lean burner 81 side for air-fuel ratio control.

In other cases, for example, in abnormal condition such that the FRA 10 at the rich burner 82 side does not detect current even if there is flame, flame detection may be executed by the FRB 12 detecting flame current of the lean burner 81.

A contact point of the spark plug 14 is bent toward the burner 8 to be arranged as depicted in FIG. 2 or 3, and the spark plug 14 executes ignition for the burner 8 by discharge from the igniter 34. The spark plug 14 may be disposed, for example, at a side of the combustion apparatus 2.

The combustion apparatus 2 depicted in FIG. 1 includes, for example, a control device 36 that executes a flame detection process and combustion control of the burner 8, and air supply control. The control device 36 is an example of means for determining distribution where a flame current value detected by the FRB 12 that is flame current detecting means is included and for determining whether this flame current value is included in a normal area. The control device 36 is also an example of means for controlling the increase and decrease of either one or both of the supply of combustion air and the supply of fuel when a flame current value detected at a detection position of the FRB 12 is not included in a normal area. The control device 36 includes, for example, PCB (Print Circuit Board). This PCB is connected to an external power supply and receives electric power supply for the water heater 4.

Function structure of flame detection and air-fuel ratio control by the control device 36 is as depicted in FIG. 4. Detection information of flame detecting means 38 and flame current detecting means 40 is taken into a determination part 44 of the control unit 42. Based on this detection information, combustion condition of the burner 8 is determined, and monitoring of a misfire and whether to be proper air-fuel ratio or not is executed. The control unit 42 outputs an airflow control command to air supply means 46 according to flame determination based on the detected flame current value so that combustion condition thereof is well. When the burner 8 is in extinction, the control unit 42 outputs control information to the fuel supply unit 22 and supply of fuel may be stopped.

In this flame detection process by the determination part 44, when, for example, flame is detected by a detection result of the flame detecting means 38, an air-fuel ratio determination process of the burner 8 may be executed.

The control device 36 may be constructed integrally with a control device that executes water heating control of the water heater 4, or may be constructed individually from a control device for water heating control.

Also, a water supply pipe 50 that takes in the supplied water W from a water tap etc. is provided for the water heater 4. The water supply pipe 50 is connected to the heat exchanger 16 and makes the supplied water W flow into the heat exchanger 16, and heat of the supplied water W is exchanged for the exhaust E. The hot water HW obtained from the heat exchange is allowed to flow out from the water heater 4 via a hot water outgoing pipe 52 connected to an outlet of the heat exchanger 16.

The water supply pipe 50 provides, for example, an incoming water temperature sensor 54 that detects entrance temperature of the supplied water W and a flow rate sensor 56 that detects the flow rate of the supplied water W. The hot water outgoing pipe 52 provides, for example, an outgoing hot water temperature sensor 58 that detects outgoing temperature of the hot water HW. The water heater 4 is equipped with a downstream shutoff valve such that a faucet or a shower is attached to the end of a hot water outgoing pipe. Detecting the flow of the supplied water W by the flow rate sensor 56 starts combustion of the burner 8, and water heating is executed. Since the combustion of the burner 8 is properly adjusted in water heating control based on information such as incoming water temperature, the flow rate of incoming water and outgoing hot water temperature, the number of the burners 8 and the supply of the fuel gas G are controlled.

Detection of flame current and determination theory of combustion condition thereof will be described with reference to FIGS. 5A to 6B. FIGS. 5A to 5D depict an example of theory of flame condition determination based on a flame current value, and FIGS. 6A to 6B depict relationship between the combustion condition and the flame current value. Each structure depicted in FIGS. 5A to 6B is an example, and does not limit the present invention.

Figure 5A:
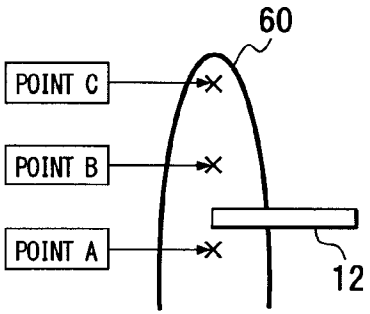
FIGS. 5A to 5D depict an example of theory of flame condition determination based on a flame current value.
Figure 6A:
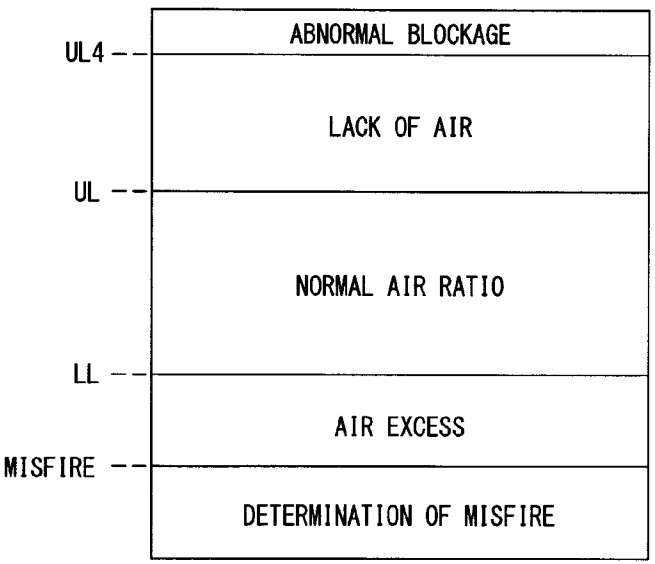
FIGS. 6A to 6B depict relationship between combustion condition and a flame current value.
Figure 6B:
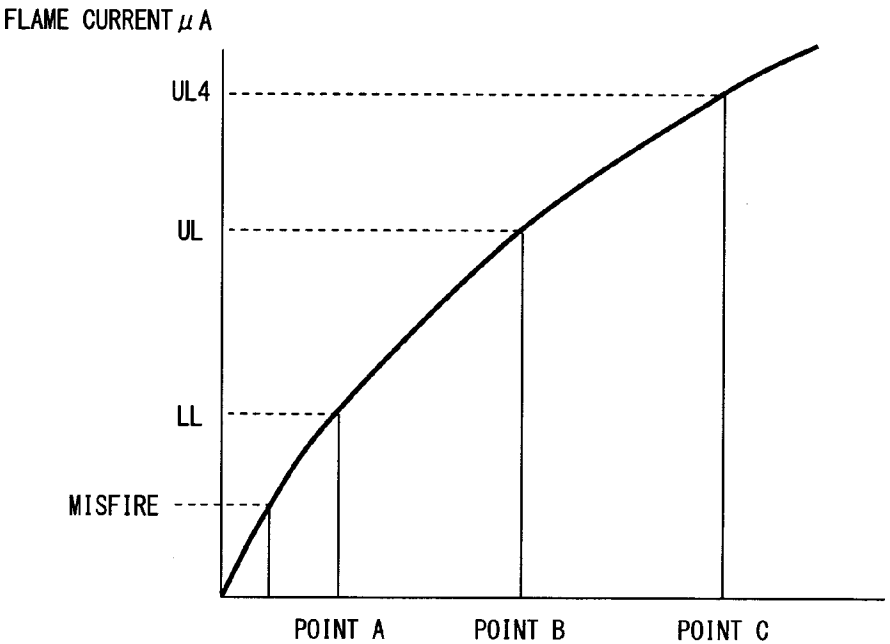

Flame 60 depicted in FIG. 5A is an example of normal combustion condition as a standard of a flame detection process, that is, the mixture ratio of air to fuel is a predetermine level. For the flame 60, a predetermined point A is set at the bottom of the burner 8 near a flame hole thereof and a predetermined point C is set near the top thereof. Also, a predetermined point B is set at the center of the flame 60, for example, at the middle position between the point A and the point C. A flame current detection result in FIG. 6B depicts that a flame current value is getting larger and larger from the point A toward the point C. In flame during combustion, the ion flow rate is different according to a detection position.

In the combustion apparatus 2, a flame current value in condition of the flame 60 is detected in order to execute flame detection and determination of combustion condition thereof, and flame current values at the above described points A, B and C are set as threshold values. A flame current detection position by the FRB 12 is set between the points A and B in the flame 60, and a range of flame current values between the points A and B of the flame 60 is defined as a normal area.

As depicted in FIG. 6A, a flame current value detected at the point A is defined as a threshold level LL (Lower limit) between air excess and normal air ratio. A flame current value detected at the point B is defined as a threshold level UL (Upper limit) between the normal air ratio and lack of air. A flame current value detected at the point C is defined as a threshold level UL4 between lack of air and abnormal blockage.

A flame current value varies according to the air-fuel ratio of the burner 8. Thus, in the combustion apparatus 2, a detection result by the FRB 12 disposed at a certain detection position is compared with flame current distribution of the flame 60 in normal air-fuel ratio, and combustion condition is determined by whether to be included in a normal area, or whether to be over or below the normal area.

If air of the proper amount is supplied as to the supply of the fuel gas G to the burner 8, the flame 60 in FIG. 5A is generated, and the FRB 12 detects a flame current value of a distribution that is set as normal values for the threshold level LL (point A) to the threshold level UL (point B) (normal area).

Figure 5B:
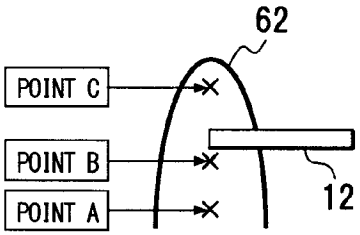

On the contrary, flame 62 depicted in FIG. 5B is small due to lack of air when, for example, the fuel gas G of a high calorific value is supplied. In such flame 62, distribution of flame current values varies. The same current values as the points A, B and C depicted in FIG. 6A are distributed at different positions. Thus, the FRB 12 that is fixed detects, for example, the current value between the points B and C. That is, the normal area ranging from A to B of the flame 62 is distributed under the position where the FRB 12 is disposed. In this case, the flame current value that the FRB 12 detects is included in an area between the threshold levels UL-UL4 (μA) as depicted in FIG. 5A to be determined to be lack of air. For such a determination result, for example, the rotation speed of the fan motor 24 is increased as improvement control of combustion condition.

Figure 5C:
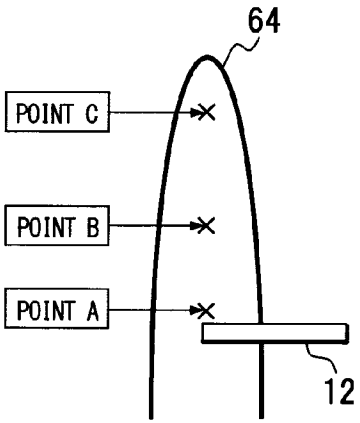

Flame 64 depicted in FIG. 5C stretches vertically due to the excess of air when, for example, the fuel gas G of a low calorific value is supplied. In the flame 64, the FRB 12 that is fixed detects, for example, a current value in the area under the point A. That is, the normal area ranging from A to B of the flame 64 is distributed over the position where the FRB 12 is disposed. In this case, the flame current value that the FRB 12 detects is included in an area under the threshold level LL (μA) as depicted in FIG. 6A to be determined to be air excess. For such a determination result, for example, the rotation speed of the fan motor 24 is controlled to be reduced.

Figure 5D:
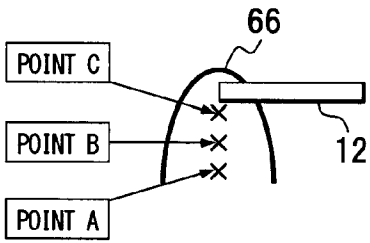

Flame 66 depicted in FIG. 5D is small because an exhaust blockage occurs by, for example, the exhaust E being covered with a wind blow toward the vent 18 or a chimney, or clogging of the heat exchanger 16. In the flame 66, the FRB 12 that is fixed detects, for example, a current value larger than the threshold level UL4 depicted by the point C to be determined to be exhaust blockage. For such a determination result, for example, control that combustion of the burner 8 is stopped is executed.

Figure 7:
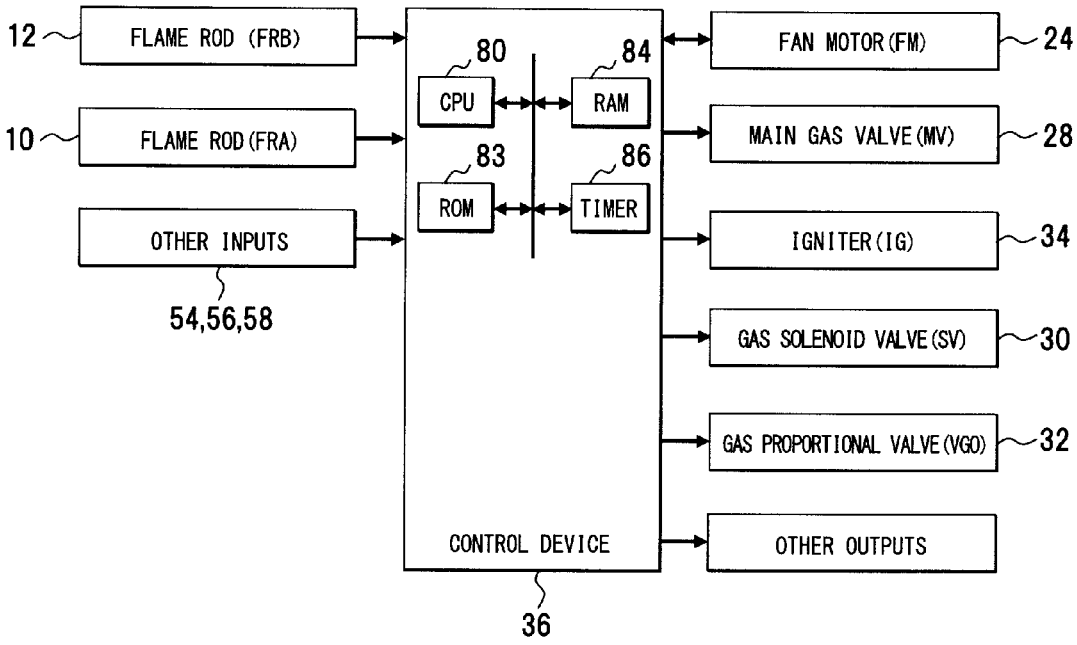
FIG. 7 depicts an example of structure of hardware of a control device.

An example of structure of the control device of the combustion apparatus will be described with reference to FIG. 7. FIG. 7 depicts an example of structure of hardware of the control device. Structure depicted in FIG. 7 is an example, and does not limit the present invention.

The control device 36 is configured by a microcomputer, and provides, for example, an input circuit taking in detection information etc., calculation means for executing various calculations, storage means for storing a control program etc., and an output circuit outputting a control signal. The control device 36 also provides, for example, a CPU (Central Processing Unit) 80, a ROM (Read-Only Memory) 83, a RAM (Random-Access Memory) 84 and a timer 86.

The CPU 80 is an example of calculation means. The CPU 80 calculates and executes a combustion control program, a combustion condition determination processing program, etc. stored in the ROM 83, and generates a control output based on combustion control on the basis of a flame determination result, detected temperature, etc.

The ROM 83 is an example of storage means for the combustion apparatus 2 or the water heater 4, stores, for example, an operation control program for operating the combustion apparatus 2 etc. and a combustion condition determination processing program, and stores data such as flame current value obtained from the FRA 10 and the FRB 12. Also, the ROM 83 stores, for example, temperature data obtained from the incoming water temperature sensor 54 and the outgoing hot water temperature sensor 58 and flow rate data of the supplied water W obtained from the flow rate sensor 56 for water heating control of the water heater 4.

The RAM 84 configures a work area for executing programs stored in the ROM 83 etc. The RAM 84 functions as the above described control unit 42 (FIG. 4), the determination part 44, etc. by executing a calculation process of a control program using the CPU 80.

The timer 86 is an example of timing means, and times the passage for a flame detecting process. The timer 86 also times the passage of time such as pre-purge time, ignition delay time and post-purge time of water heating control.

To the control device 36, for example, flame current values are inputted from the FRA 10 and the FRB 12 as flame detection information. Also, for example, rotating speed information etc. are inputted thereto from the fan motor 24. Based on the input information, combustion condition determination of the burner 8 is executed, for example, and based on a determination result thereof, a control command is outputted to the fan motor 24, the main gas valve 28, the igniter 34, the gas solenoid valve 30, the gas proportional valve 32, etc.

In addition, a determination result of combustion condition and an alarm may be outputted to informing means such as a speaker, a buzzer and a display unit.

Figure 8:
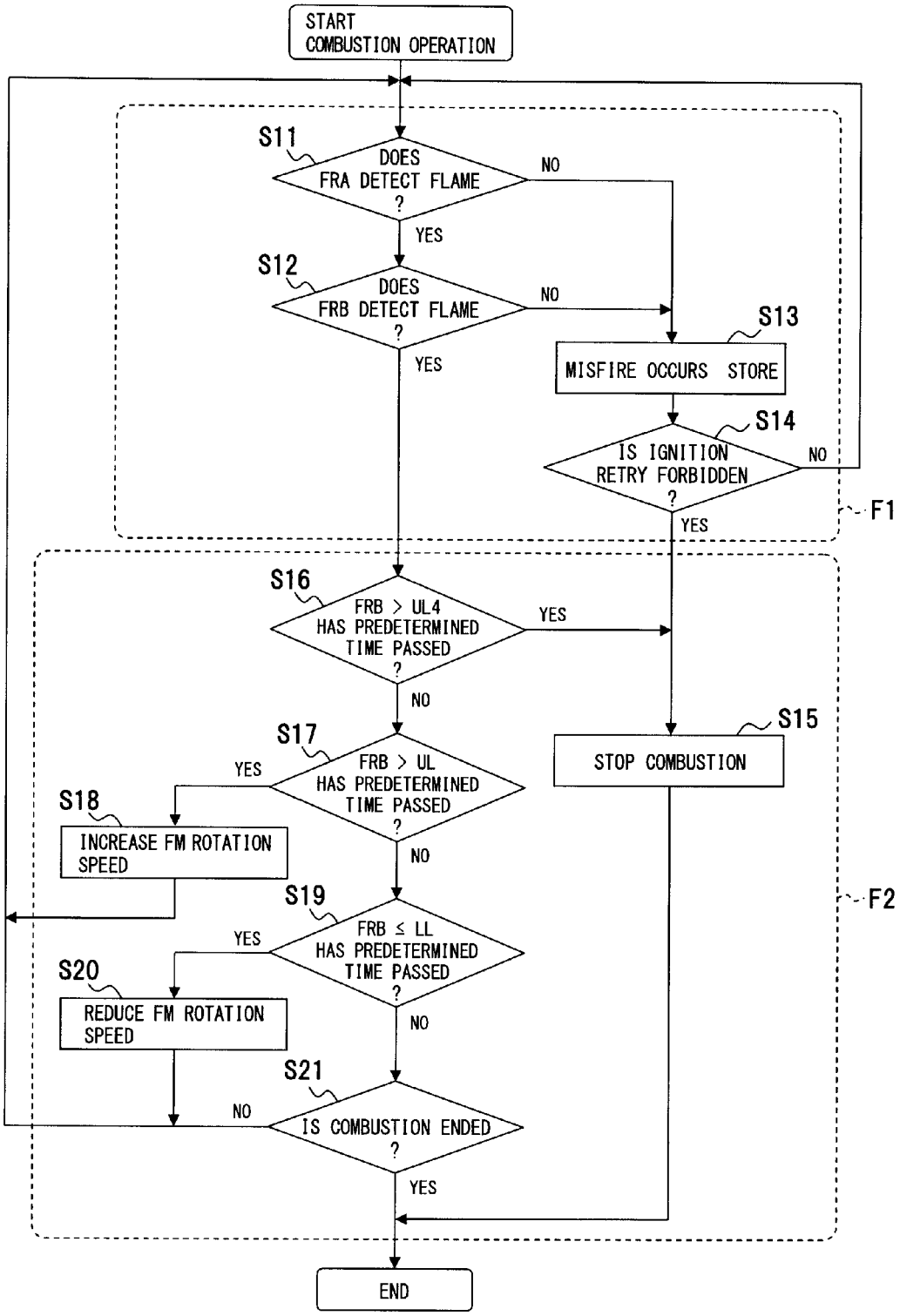
FIG. 8 is a flowchart depicting an example of a combustion control process.

A combustion condition determination process and combustion operation control by flame detection will be described with reference to FIG. 8. FIG. 8 is a flowchart depicting an example of a combustion control process. Processing contents, processing procedures, etc. depicted in FIG. 8 are an example, and do not limit the present invention.

This combustion condition determination process and combustion operation control process are an example of a combustion control method of the present invention, and for example, include a flame detection process (F1) by the FRA 10 and the FRB 12 and a combustion condition determination process (F2) based on a flame current value detected by the FRB 12.

The flame detection process F1 is executed, for example, during water heating combustion by the combustion apparatus 2. When it is determined that there is flame by the flame detection process of the FRA 10, flame detection by the FRB 12 is executed. In this flame detection, whether there is flame or not is determined by ON/OFF of flame current by the FRA 10. The FRB 12 may determine whether there is flame (combustion condition) based on, for example, the detected flame current value.

After combustion operation of the burner 8 is started, the flame detection process by the FRA 10 is executed (step S11). When the FRA 10 detects flame current (YES of step S11), the process moves to flame detection by the FRB 12 (step S12). When flame is not detected, that is, when the FRA 10 does not detect flame current (NO of step S11), the control device 36 determines that a misfire occurs, and a determination result thereof is allowed to be stored into, for example, the ROM 83 that is a storage unit (step S13). The ROM 83 includes a storage area for storing, for example, a determination result of combustion condition. The ROM 83 may include a table for control for being allowed to store the determined result to be used for combustion control. When ignition retry can be permitted based on an examination result of a cause of the misfire (NO of step S14), the process returns to step S11. Whether to forbid ignition retry or not may be determined automatically by setting conditions thereabout in the combustion apparatus 2 and the water heater 4 in advance.

When a misfire is determined by the flame detection process of the FRA 10 or the FRB 12, the flame detection process is ended and combustion is stopped (step S15). Here, when the FRA 10 detects a misfire, for example, during water heating combustion, the FRA 10 is normal, and combustion control may be executed according to a detection result thereof. When a misfire is detected by the FRA 10, detection of a current value by the FRB 12 is not executed. When the FRA 10 determines that there is flame (YES of step S11) and when the FRB 12 does not detect a flame current value (NO of step S12), it is determined that the FRA 10 is abnormal condition, and alarm display may be executed.

In measurement of a flame current value by the FRB 12, a certain time passage is needed till stable combustion.

When there is flame in the burner 8, the process moves to the determination process of combustion condition thereof (F2). With reference to the flame current value detected by the FRB 12, it is determined whether a predetermined time has passed since this current value is over the threshold level UL4, for example, 60 (μA) or not (step S16). When the predetermined time has passed while the detected value by the FRB 12 is kept over the threshold level UL4 (YES of step S16), it is determined that an exhaust blockage occurs, and combustion is stopped (step S15).

When the predetermined time has not passed since the flame current value detected by the FRB 12 is over the threshold value UL4 (NO of step S16), it is determined that exhaust abnormality such as an exhaust blockage does not occur in the vent 18 etc. of the combustion apparatus 2. It is determined whether the predetermined time has passed since the detected flame current value is over the threshold level UL, for example, 30 (μA) or not (step S17). When the predetermined time has passed while the current value is kept over the threshold level UL (YES of step S17), it is determined that the air volume is lacking, and the rotation speed of the fan motor 24 is increased (step S18).

In rotation speed control of the fan motor 24, the rotation speed may be increased for each speed which is set in advance, or may be increased according to a detected flame current value. Alternatively, a threshold level UL2 and a threshold level UL3 which are ramified are set between the threshold level UL and the threshold level UL4, and the increase level of the rotation speed of the fan motor 24 and detection time may be set for each threshold level.

When the predetermined time has not passed since the detected flame current value is over the threshold level UL (NO of step S17), it is determined whether the predetermine time has passed since the flame current value is equal to or under the threshold level LL, for example, 5 (μA) or not (step S19). When the predetermined time has passed while the flame current value is kept equal to or under the threshold level LL (YES of step S19), air excess is determined and the rotation speed of the fan motor 24 is reduced (step S20).

This determination process of combustion condition is repeatedly executed till combustion stop because the predetermined time has passed while the detected flame current value is kept or over the threshold level LL, or because the flow rate of the supplied water W reduces to an OFF point (step S21).

When increasing and decreasing control of the rotation speed of the fan motor 24 is repeatedly executed, combustion may be stopped to issue warning by an alarm. When a water heating request occurs to the water heater 4 again, once water heating was ended, to execute combustion of the burner 8, the rotation speed of the fan motor 24 may be a speed before executing rotation speed control, or may be set to a speed after the rotation speed control.

In the flame detection process F1, the detection process by the FRB 12 is executed according to the detection result of the FRA 10. The detection process is not limited thereto. Flame detection may be executed by executing detection of a flame current value by the FRA 10 and the FRB 12 at the same time.

According to such structure, a change of condition of combustion of combustion means (burner) is rapidly detected by a change of a detected current value of flame current detecting means disposed in a predetermined monitoring position, and control such as improvement and stop of the combustion is performed. Thereby, the safety can be improved and proper combustion condition can be maintained. Sudden deterioration of a combustion environment due to an exhaust blockage etc. can be rapidly detected by detection of a flame current value. Thereby, the safety can be improved.

Second Embodiment

Figure 9:
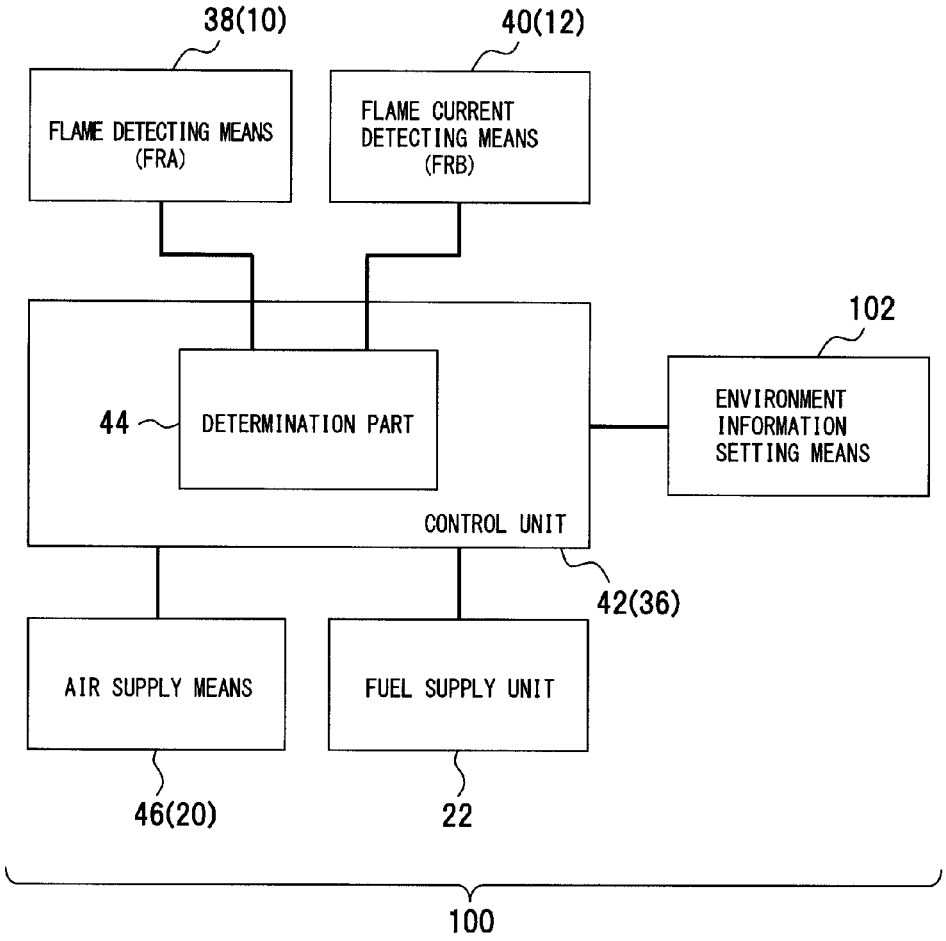
FIG. 9 depicts an example of structure of functions of a combustion apparatus according to a second embodiment.

A second embodiment will be described with reference to FIGS. 9 and 10. FIG. 9 depicts an example of structure of functions of a combustion apparatus according to the second embodiment and FIG. 10 depicts an example of structure of a setting table of dipswitches. Each structure depicted in FIGS. 9 and 10 is an example, and does not limit the present invention. In FIG. 9, the same components as those in FIG. 4 are denoted by the same reference numerals, and description thereof is omitted.

A combustion apparatus 100 is an example of a combustion apparatus of the present invention. Information of an environment where the water heater 4 including the combustion apparatus 100 is disposed is obtained, and combustion control according to a disposed environment thereof is executed. For example, height data is used for this disposed environment. The combustion apparatus 100 depicted in FIG. 9 includes environment information setting means 102. For example, when the water heater 4 is constructed, height data is set and is used for a determination process of combustion condition of the burner 8 and a combustion control process based on a determination result thereof.

The reason why height data is used for combustion control is that, for example, when the height gains, combustion air tends to be lacking due to decrease of atmospheric pressure. That is, when height data is not considered as to the combustion apparatus 100, combustion improvement progresses since an initial step, a process moves to a combustion stop step faster than the case of being disposed at the low land areas, and a warning alarm etc. may be issued. Some height conditions determine bad combustion as soon as the combustion apparatus 100 is disposed, and operation of the water heater 4 or the like may not be executed. Therefore, the supplies of combustion air and gas are adjusted according to an environment where a device is disposed.

combustion improvement according to a disposed environment can be executed by executing an initial setting so that a current value of the FRB 12 is detected according to height data of a disposed device as environment information, and proper combustion air is supplied.

For example, a dipswitch (SW) is provided as the environment information setting means 102. Environment information is set when the combustion apparatus 100 is disposed. A dipswitch setting table 104 depicted in FIG. 10 is, for example, stored in the ROM 83 in the control unit 42, and executes adjustment of a command output from the control unit 42 according to setting condition of a dipswitch.

In the dipswitch setting table 104, for example, control information for a predetermined height 1 to height 3 is set by the combination of a dipSW 1 and a dipSW 2. When the dipSW 1 and the dipSW 2 are switched according to the height of the place where the combustion apparatus 100 is disposed, the control unit 42 outputs control information to the air supply means 46 so as to increase the rotation speed of the fan motor 24 faster than an initial condition.

In combustion control, for example, combustion improvement processes of 15 steps are set as to the rotation speed of the fan motor 24. These steps are a total of 10 steps that are from an initial state to lack of air and 5 steps that are from the initial state to excess. However, if combustion improvement by the above described combustion condition determination is executed when the combustion apparatus 100 is disposed at a higher place, combustion improvement may progress to 7 or 8 step when a device is started to be used. Thus, the environment information setting means 102 executes combustion control in view of height data.

Figure 11:
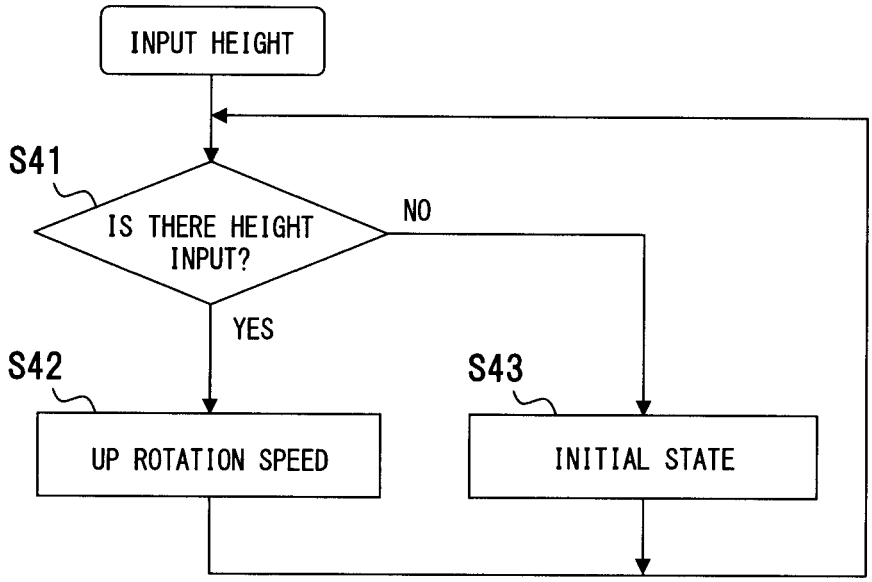
FIG. 11 is a flowchart depicting an example of a combustion control process including height data.

Rotation speed control by height data will be described with reference to FIG. 11. FIG. 11 is a flowchart depicting an example of a combustion control process including height data. Processing contents, processing procedures, etc. depicted in FIG. 11 are an example, and do not limit the present invention.

When setting is performed by a height input as to the dipSW 1 and the dipSW 2 (YES of step S41), the rotation speed of the fan motor 24 is increased based on the dipswitch setting table 104 (step S42). In this rotation speed increase process, for example, when "height 1" is set by the dipSW 1 turned ON and the dipSW 2 turned OFF, the rotation speed is increased by X (%) for the initial setting. When "height 2" is set by the dipSW 1 turned OFF and the dipSW 2 turned ON, the rotation speed is increased by Y (%). When "height 3" is set by the dipSW 1 turned ON and the dipSW 2 turned ON, the rotation speed is increased by Z (%). For example, the higher setting height is, the larger this increase of the rotation speed may be set.

When the dipSW is not changed, that is, when setting of height input is not executed (NO of step S41), the initial state is maintained (step S43).

The flame detection process (F1, FIG. 8) and the combustion condition determination process (F2, FIG. 8) may be executed using the rotation speed set in this rotation speed setting process. The structure, processing procedures and processing contents depicted in the above embodiment may also be executed in this embodiment, and description thereof is omitted.

The environment information setting means 102 is not limited to the case of using preset height data. For example, an altimeter is provided and information of environment where the combustion apparatus 100 is disposed may be measured. Also, environment information of a disposed position may be obtained from the outside by a GPS (Global Positioning System), a network, or the like. Further, height data is exemplified as environment information, but environment information is not limited thereto. For example, atmospheric pressure information or climatic information may be used for combustion control.

According to such stricture, executing combustion control in view of height data can prevent combustion improvement steps from being less than a lower place even if the combustion apparatus 100 is disposed at a higher place. Combustion control can be performed according to an environment where a combustion apparatus is disposed by changing the ratio of the controlled supply of air and fuel according to the environment. Thereby, the convenience of the combustion apparatus can be improved. A change of condition of combustion of combustion means (burner) is rapidly detected by a change of a detected current value of flame current detecting means disposed in a predetermined monitoring position, and control such as improvement and stop of the combustion is performed. Thereby, the safety can be improved. Sudden deterioration of a combustion environment due to an exhaust blockage etc. can be rapidly detected by detection of a flame current value. Thereby, the safety can be improved.

Example

Figure 12:
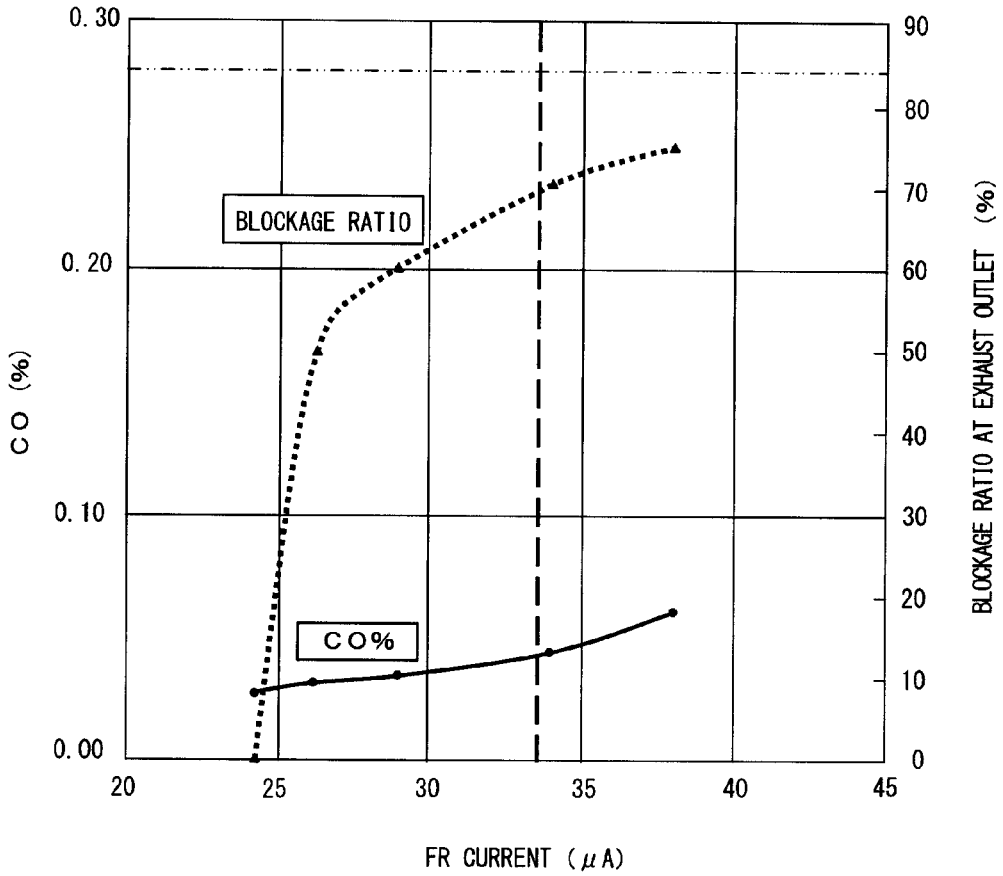
FIG. 12 depicts an example of detection of the level of CO and an exhaust blockage by a flame rod.

An example of a detecting process of the level of CO and exhaust blockage ratio by flame current detecting means will be described with reference to FIG. 12. The level of CO, blockage ratio at an exhaust outlet and FR current value depicted in FIG. 12 are an example.

In the combustion apparatus 2, monitoring the increase of the level of CO in the combustion apparatus 2, especially in the combustion chamber 6 and the blockage ratio in the vent 18 can be executed based on, for example, a flame (FR) current value detected by the FRB 12. In this monitoring process, an FR current value is measured by the FRB 12 during the execution of a normal combustion process as described above. The increase of the level of CO and blockage at an exhaust outlet are monitored based on determination information representing the relationship among an FR current value, the level of CO and the blockage ratio at an exhaust outlet depicted in FIG. 12. Determination information thereof may be stored in the ROM 83 of the control device 36 etc.

When an FR current value equal to or over a predetermined threshold value is detected from a monitoring result, a combustion improvement process may be executed by adjustment of the opening of the gas proportional valve 32 etc. or rotation speed control of the fan motor 24. An informing process may be executed using informing means of the combustion apparatus 2.

Features and advantages of the combustion apparatus and combustion control method therefor of the present invention described above are as follows.

(1) In this combustion apparatus 2, for example, the burner 8 combusts fuel and the FRA 10 detects whether there is flame in combustion means or not. The FRB 12 detects a value of flame ion current during combustion in the burner 8. The determination part 44 determines whether to be a misfire or not based on a detection result by the FRA 10 and determines whether to be proper combustion or not based on a detection result by the FRB 12. The control unit 42 stops the supply of fuel to the burner 8 or controls the rotation speed of the fan motor 24 in response to determination results by the determination part 44.

(2) The combustion apparatus 2 includes the timer 86. When the FRA 10 detects whether there is flame or not, the FRB 12 detects flame current equal to or over a threshold value, and a predetermined time has passed after the detection, the determination part 44 determines that combustion air is lacking or excess, and the rotation speed of the fan motor 24 is changed.

(3) The FRB 12 may be used for flame detection in this combustion apparatus 2.

(4) A dipswitch for executing combustion control according to height data as disposed environment information may be provided in this combustion apparatus 2.

(5) According to this combustion apparatus and combustion control method therefor, flame is detected by the FRA 10 and the FRB 12 to determine combustion condition. Based on a determination result thereof, the volume of air is adjusted to improve and stop combustion. Thereby, monitoring accuracy is improved and the safety of this combustion apparatus can be enhanced.

(6) Monitoring of flame current by the FRB 12 can detect exhaust blockage as a sudden current change. Thus, combustion can be normalized or stopped and the safety can be enhanced.

(7) Monitoring of flame current by the FRB 12 enables normal combustion irrelevantly to difference of calorific values of fuel and difference of the volume of oxygen at highlands etc.

(8) Detecting and monitoring combustion condition (air-fuel ratio) by the FRB that detects flame can maintain proper combustion condition in the combustion apparatus 2.

(9) According to the combustion condition determination process in the combustion apparatus 2, a sudden change of combustion condition or a sudden change of environment in the combustion chamber 6 can be detected from a change of a flame current value.

(10) Since flame detection and monitoring of combustion can be executed using the flame rods (FRA 10, FRB 12), a special circuit or control device is not needed, and simple structure can be achieved.

Other Embodiments (1) In the above embodiments, two flame rods of the FRA 10 and the FRB 12 execute flame detection and flame current detection. The present invention is not limited thereto. For example, only the FRB 12 may execute flame detection and flame current detection processes. According to such structure, the objects of the present invention can also be achieved.

(2) In the above embodiments, the water heater 4 is exemplified as an apparatus mounting the combustion apparatus 2. The present invention is not limited thereto. A device executing combustion by the burner 8 and executing a process for improving air-fuel ratio by rotation speed control of the fan motor 24 and fuel supply control of the fuel supply unit 22 may be applied. For example, the combustion apparatus 2 may be used for a water heating device that has a water reheating function, a heater, and the like.

While the most preferred embodiments of the present invention have been described hereinabove, the present invention is not limited to the above embodiments, and it is a matter of course that various variations and modifications can be made by those skilled in the art within the scope of the claims without departing from the spirit of the invention disclosed herein, and needless to say, such variations and modifications are also encompassed in the scope of the present invention.

The combustion apparatus and combustion control method therefor of the present invention can execute a combustion process in proper air-fuel ratio, and improving monitoring accuracy of combustion can enhance the convenience and the safety of a heat pump. Thus the present invention is useful.

What is claimed is:

1. A combustion apparatus, comprising:

combustion means that generates flame by combustion;

air supply means that supplies air to the combustion means;

flame current detecting means that is set at a certain detection position and detects a flame current value included in the flame which is generated by the combustion means;

flame detecting means that detects whether there is the flame or not in the combustion means;

determination means that executes a determination process of a distribution that includes the flame current value detected by the flame current detecting means when the flame detecting means detects the flame; and control means that, when a current value in the distribution that includes the flame current value is higher than a current value in a distribution which is set as normal values, outputs a control command to increase a supply of the air by the air supply means, and that, when the current value in the distribution that includes the flame current value is lower than the current value in the distribution which is set as the normal values, outputs a control command to decrease the supply of the air by the air supply means, based on a determination result by the determination means.

2. The combustion apparatus of claim 1, wherein the control means stops the combustion of the combustion means when the determination result is over a threshold level representing an exhaust blockage.

3. The combustion apparatus of claim 1, further comprising an environment information setting means that takes in environment information, wherein the control means changes ratio of increase and decrease of the supply of the air of the air supply means according to the environment information that is taken in or that is set.

4. A combustion control method, comprising:

generating flame by combustion of combustion means;

supplying air to the combustion means by air supply means;

detecting, by a flame current detecting means set at a certain detection position, a flame current value included in the flame which is generated detecting whether there is the flame, which is generated by the combustion means, or not; and executing a determination process of a distribution that includes the flame current value detected by the flame current detecting means when the flame is detected;

wherein when a current value in the distribution that includes the flame current value is higher than a current value in a distribution which is set as normal values, a supply of the air by the air supply means is increased, based on a determination result by said determining; and wherein when the current value in the distribution that includes the flame current value is lower than the current value in the distribution which is set as the normal values, the supply of the air by the air supply means is decreased, based on the determination result by said determining.

5. The combustion control method of claim 4, further comprising:

stopping the combustion when the determination result is over a threshold level representing an exhaust blockage.

6. The combustion control method of claim 4, further comprising:

taking in environment information; and changing ratio of increase and decrease of the supply of the air of the air supply means according to the environment information that is taken in or that is set.

7. A combustion apparatus, comprising:

combustion means that generates flame by combustion;

air supply means that supplies air to the combustion means;

flame current detecting means that is set at a certain detection position and detects a flame current value included in the flame which is generated by the combustion means;

determination means that determines a distribution that includes the flame current value detected by the flame current detecting means; and control means that, when a current value in the distribution that includes the flame current value is higher than a current value in a distribution which is set as normal values, outputs a control command to increase a supply of the air by the air supply means, and that, when the current value in the distribution that includes the flame current value is lower than the current value in the distribution which is set as the normal values, outputs a control command to decrease the supply of the air by the air supply means, based on a determination result by the determination means, wherein the control means stops the combustion of the combustion means when the determination result is over a threshold level representing an exhaust blockage.

8. The combustion apparatus of claim 7, further comprising an environment information setting means that takes in environment information, wherein the control means changes ratio of increase and decrease of the supply of the air of the air supply means according to the environment information that is taken in or that is set.

9. A combustion control method, comprising:

generating flame by combustion of combustion means;

supplying air to the combustion means by air supply means;

detecting, by a flame current detecting means set at a certain detection position, a flame current value included in the flame which is generated;

determining a distribution that includes the flame current value detected by the flame current detecting means;

wherein when a current value in the distribution that includes the flame current value is higher than a current value in a distribution which is set as normal values, a supply of the air by the air supply means is increased, based on a determination result by said determining;

wherein when the current value in the distribution that includes the flame current value is lower than the current value in the distribution which is set as the normal values, the supply of the air by the air supply means is decreased, based on the determination result by said determining; and wherein when the determination result is over a threshold level representing an exhaust blockage, the combustion is stopped.

10. The combustion control method of claim 9, further comprising:

taking in environment information; and changing ratio of increase and decrease of the supply of the air of the air supply means according to the environment information that is taken in or that is set.

11. A combustion apparatus, comprising:

combustion means that generates flame by combustion;

air supply means that supplies air to the combustion means;

a first flame rod which detects a current for determining whether the flame is present or not, based on whether the current which is detected by the first flame rod is over a predetermined threshold value or not;

a second flame rod that is set at a certain detection position and detects a flame current value included in the flame, which is generated by the combustion means;

determination means that determines a distribution that includes the flame current value detected by the second flame rod; and control means that, when a current value in the distribution that includes the flame current value is higher than a current value in a distribution which is set as normal values, outputs a control command to increase a supply of the air by the air supply means, and that, when the current value in the distribution that includes the flame current value is lower than the current value in the distribution which is set as the normal values, outputs a control command to decrease the supply of the air by the air supply means, based on a determination result by the determination means.

12. The combustion apparatus of claim 11, wherein the combustion means includes one or more lean burners and one or more rich burners, wherein the first flame rod is arranged across at least one of said one or more lean burners and at least one of said one or more rich burners, and wherein the second flame rod is directed to one of said one or more lean burners.

13. A combustion control method comprising:

generating flame by combustion of combustion means;

supplying air to the combustion means by air supply means;

detecting a current at a first flame rod, and determining whether the flame is present or not, based on whether the current which is detected is over a predetermined threshold value or not;

detecting, by a second flame rod set at a certain detection position, a flame current value included in the flame which is generated;

determining a distribution that includes the flame current value detected by the second flame rod;

wherein when a current value in the distribution that includes the flame current value is higher than a current value in a distribution which is set as normal values, a supply of the air by the air supply means is increased, based on a determination result by said determining; and wherein when the current value in the distribution that includes the flame current value is lower than the current value in the distribution which is set as the normal values, the supply of the air by the air supply means is decreased, based on the determination result by said determining.

14. The combustion apparatus method of claim 13, wherein the combustion means includes one or more lean burners and one or more rich burners, wherein the first flame rod is arranged across at least one of said one or more lean burners and at least one of said one or more rich burners, to detect the current, and wherein the second flame rod is arranged so as to be directed to one of said one or more lean burners, to detect the flame current.

* * * * *